United States Patent [19]

Schneider et al.

[11] Patent Number: 5,001,921

[45] Date of Patent: Mar. 26, 1991

[54] TRANSFER DEVICE IN A TRANSFER PRESS OR SIMILAR METAL-FORMING MACHINE

[75] Inventors: Franz Schneider; Hans Hofele, both of Göppingen; Kurt Strommer, Kunchen; Sieghard Mueller, Ottenbach, all of Fed. Rep. of Germany

[73] Assignee: L. Schuler GmbH, Fed. Rep. of Germany

[21] Appl. No.: 542,720

[22] Filed: Jun. 25, 1990

Related U.S. Application Data

[63] Continuation-in-part of Ser. No. 380,508, Jul. 17, 1989, abandoned.

[30] Foreign Application Priority Data

Feb. 18, 1989 [DE] Fed. Rep. of Germany ..... 3905068

[51] Int. Cl.[5] ..... B21D 43/05

[52] U.S. Cl. ..... 72/405; 198/621

[58] Field of Search ..... 72/405, 422, 448, 446; 198/621; 414/752, 751

[56] References Cited

U.S. PATENT DOCUMENTS 4,557,133 12/1985 Mikasch ..... 72/405

4,866,974 9/1989 Shiraishi ..... 72/405

4,873,860 10/1989 Werner ..... 72/405

*Primary Examiner*—Daniel C. Crane

*Attorney, Agent, or Firm*—Evenson, Wands, Edwards, Lenahan & McKeown

[57] ABSTRACT

A transfer device permits different moving sequences of holding devices for the sheet metal parts which are to be moved through the metal-forming machine. The holding devices are fastened to carriages. The carriages are cam-guided, in which case a first carriage carries out a transfer movement from a working stage to an idle stage while taking along a sheet metal part. The return movement is interrupted in an intermediate position during the deforming operation of the sheet metal parts. A second Carriage carries out a transfer movement from the idle stage to a working stage and a return movement which is temporarily interrupted in an intermediate stage. The vertically extending motional parts of curves are used for the picking-up and depositing of sheet metal parts in working stages; the extended lowering movement is used for the depositing of the holding devices on sliding tables which can be moved into the press. As a result of the low-mass construction by means of carriages, high accelerations are possible in the movements. The transfer movements are shortened significantly by the use of intermediate depositing devices in the idle stages.

11 Claims, 8 Drawing Sheets

TRANSFER DEVICE IN A TRANSFER PRESS OR SIMILAR METAL-FORMING MACHINE

This is a continuation in part of application Ser. No. 07/380,508 filed on July 17, 1989, now abandoned.

BACKGROUND AND SUMMARY OF THE INVENTION

The invention relates to a transfer device in a transfer press or similar metal-forming machine.

Reference is made to the below listed related U.S. patent applications:

(i) U.S. application Ser. No. 07/413,607, filed Sept. 28, 1989, based on German Application No. P 39 05 073.4 filed in Germany on Feb. 18, 1989 33985; and (ii) U.S. application Ser. No. 07/428,587, filed Oct. 30, 1989 based on German Application No. P 39 05 069.6 filed in Germany on Feb. 18, 1989 33987.

Transfer presses, bulky-part transfer presses, press installations are metal-forming machines, in which sheet metal parts are deformed by process steps, such as drawing and punching. For this purpose, the presses have at least one slide, at which a tool or a tool set (upper tool) is fastened which cooperates with a tool or tool set (lower tool) in the press bed or on a sliding table. The slides can be moved up and down by means of driving devices of the press. Intermediate depositing devices are mounted in areas between the frames leading to presses arranged behind them, these areas being known as idle stages. The changing of the tools or tool sets takes place utilizing of sliding tables which, for this purpose, can be moved into and out of the press.

In U.S. Patent Specification (US-PS) 4,625,540, a press is disclosed having a device for transferring sheet metal parts between working stages. This transfer device has two moving rails on both sides of the slide and tools and extending in conveying direction of the sheet metal parts. The moving rails are supported on the press bed by supports. In addition, a plate is provided for each moving rail, having rollers for placement on the moving rails. Both plates are connected with one another by a strut. Two transfer rods are disposed at the strut which extend in parallel with respect to the moving rails. The transfer rods are connected with a cam follower lever which receives a swinging motion from a control cam. On the side of the drive, the control cam is operatively connected with the main drive of the press. The transfer rods are rigidly connected with one another by traverses.

In guides of the transfer rods, cross bars are arranged which by means of an additional drive can be moved relative to the transfer rods. Vacuum suction devices are mounted at the cross bars which, by means of the movement of the cross bars, can be adjusted to the length of the sheet-metal parts. For the deforming stage, the cross bars with the vacuum suction devices can be adjusted into areas outside the slides and the tools. The transfer rods can be lifted and lowered by means of lifting devices which are not shown or explained in detail. The setting-up of the vacuum suction device with respect to the changed size of new sheet metal parts during the retrofitting of the press must take place manually without the possibilities of prior setting-up during the operating of the press Accordingly, it is an object of the present invention to provide a transfer device which permits a changing operation of the holding devices to accommodate sheet metal parts of different sizes. In particular, the changing operation of the holding devices takes place automatically and at the same time with the change of the tools via a sliding table arrangement. The changing position of the holding devices or the devices carrying these holding devices is achieved independently of the drive for the transfer movements of the sheet metal parts.

Preferred embodiments of the present invention have a low-mass construction which is advantageous. The driving devices and the devices of the transfer device which transfer and deflect the movements are assigned to the area (head area) of the press or presses, in which the driving devices for the slide or the slides are also housed. The transfer device can be retrofitted in press trains as well as in compact presses. Other advantages of preferred embodiments of the present invention are the short transfer movements of the carriages and their temporary waiting position outside the working stages during the deforming phases.

In a particularly advantageous manner, the transfer device according to preferred embodiments of the present invention can be used in a new type of hybrid press installation with intermediate depositing devices set up between two working stages (idle stages) because the carriages, in pairs, can carry out different movements if the drive is designed correspondingly. The sandwich construction particularly of the carriages and the traverses not only permits the fastest possible adaptation to new sheet metal sizes and other sheet metal shapes, it also allows the simple removal and replacement of components and subassemblies.

Other objects, advantages and novel features of the present invention will become apparent from the following detailed description of the invention when considered in conjunction with the accompanying drawings.

DETAILED DESCRIPTION OF THE DRAWINGS

Figure 1:
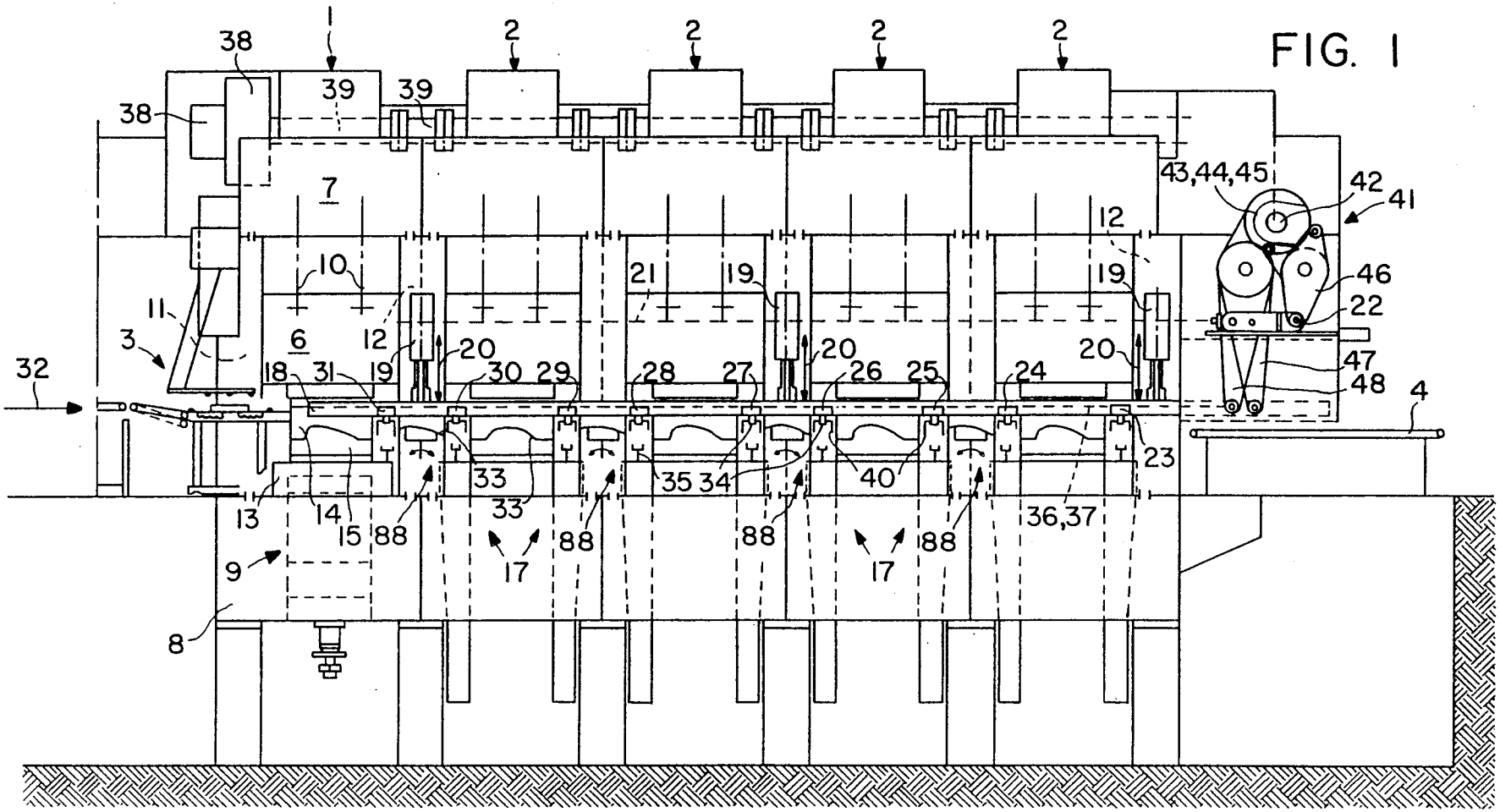
FIG. 1 is a front view of a hybrid press installation, in which frames located at the front of the installation are not shown.

In the Figures, a hybrid press installation is shown having a head press 1, which may be a drawing press, and having additional presses 2, of which at least one press may contain an additional redrawing stage. The head pieces 7 of the individual presses 1, 2 are supported on press beds 8 by means of frames 11, 12.

Reference number 10 indicates connecting rods which, for example, by means of a crankshaft drive originating from a main drive shaft 39, drive the slides 6 of the presses 1, 2 in an upward and downward movement. The main shaft 39 is rotationally moved by one or several motors by means of a clutch/brake unit 38.

Figure 2:
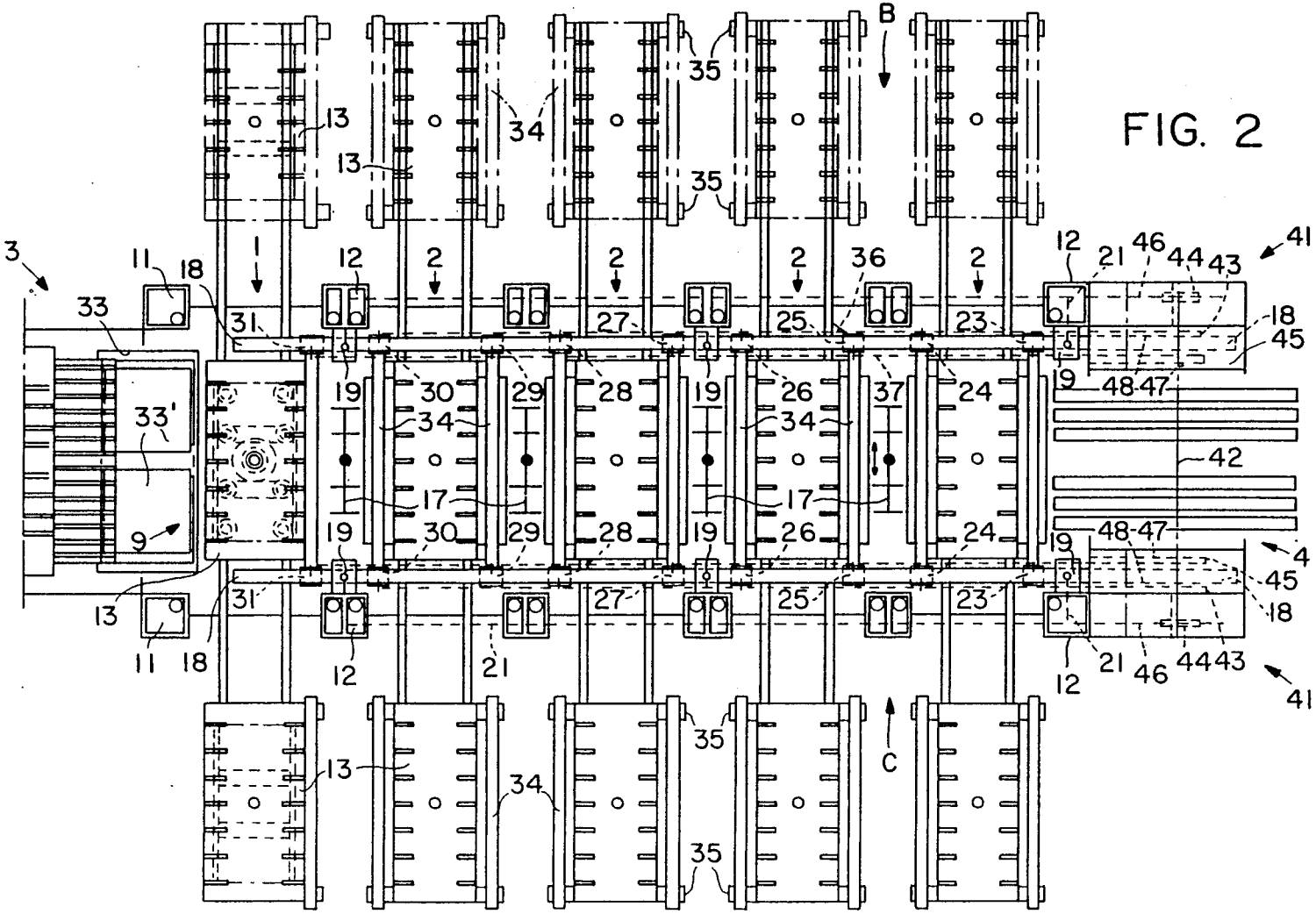
FIG. 2 is a top view of the hybrid press installation according to FIG. 1, in which head pieces are not shown.

By means of the paired sets of sliding tables 13 best seen in FIG. 2, tools or tool sets 14, 15 can be moved into the working stages of the presses 1, 2 and can therefore be exchanged, in which case the tool or the tool set 15 (lower tool part) for the deforming operation of the presses remains on the respective sliding table 13. The tool or the tool set 14 (upper tool part) moves with the movement of the slide 6. A drawing apparatus 9 is outlined for the head press 1.

The metal sheets 33 which are fed, for example, to the head press 1 by means of a feeding device 3 are moved from one working stage to the next working stage by means of a transfer device 5 and guided to a removal station 4. Sheet metal parts of different sizes, which are to be conveyed and worked, as shown in FIG. 2, have the reference number 33' and can also be accommodated by the transfer device 5. The direction and the level of the sheet metal conveyance has the reference number 32.

Intermediate depositing devices 17 for the depositing of the sheet metal parts 33 are set up in the idle-stage areas 88 between the working stages. Supports 35 are provided at the sliding tables 13 for receiving the traverses 34 of the transfer device 5 as will be described in the following.

Figure 3:
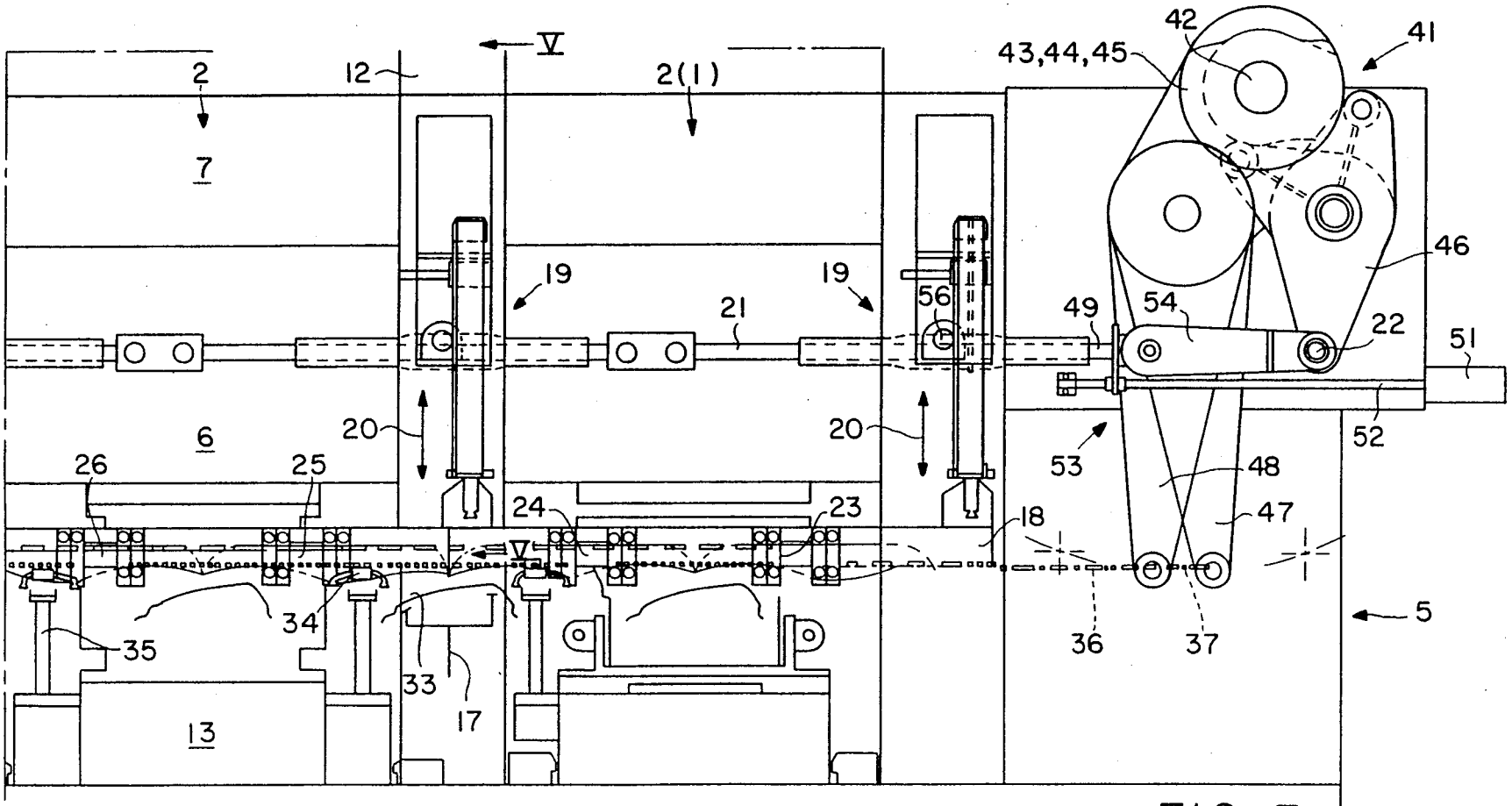
FIG. 3 is an enlarged cutout of FIG. 1 with the driving devices for the transfer device according to one embodiment of the present invention.

The transfer device 5 shown in FIGS. 1, 2 and 3 has two moving rails 18, one of which, as viewed in FIG. 1, is arranged behind the slides 6 with the upper tool parts 14, and the second moving rail is arranged in front of the slides 6 with the upper tool parts 14. The moving rails 18 extend in the longitudinal direction of the shown hybrid press installation. The moving rails 18 can be lifted and lowered (double arrow 20 in FIG. 1) by adjusting devices or the like, such as air cylinders, or, as shown, by means of deflection gears 19. The deflection gears 19 will be explained in detail with respect to FIGS. 5 and 6.

The deflection gears 19 of the rear frame side B of the hybrid press installation and those of the front frame side C are each connected by means of one lifting rod linkage 21 respectively, at pivotal points 22, with one cam follower lever 46 respectively for each frame side of a cam disk arrangement which, as a whole, has the reference number 41. As outlined in FIGS. 1 and 2 and shown in detail in FIGS. 3 and 4, carriages 23 to 31 of the transfer device 5 are disposed at each of the moving rails 18.

Carriages 23, 25, 27, 29 and 31, by means of a conveying rod system 37, are connected with one another and with a cam follower lever 47. Carriages 24, 26, 28 and 30, by means of a conveying rod system 36, are connected with one another and with a cam follower lever 48. Carriages 23 to 31, which are located opposite one another on the spaced moving rails 18, are connected with one another by means of traverses 34. Suction devices 40 or similar holding devices are arranged at the traverses 34 for the gripping of the sheet metal parts 33, 33' and for conveying them through the hybrid press installation. The conveying rod system 36, 37 may be arranged on both sides of the moving rails 18, as seen in FIG. 2, or on one side of the moving rails.

The cam disk arrangement 41, as shown in detail in FIGS. 2 and 3, comprises a cam disk shaft 42. The cam disk shaft 42 is rotated by the main shaft 39 by means of deflecting or transfer gears. These devices, which are known in metal-forming machines, are not shown. For each frame side B, C of the press installation, one cam disk 44 for the movement of one of the two cam follower levers 46, one cam disk 45 for the movement of one of the two cam follower levers 47 and one cam disk 43 for the movement of one of the two cam follower levers 48 is non-rotatably arranged on the cam disk shaft 42. The cam disks 44, 43, 45 may be double cam disks for generating a controlled motion in the lifting and lowering movements of the moving rails 18 and the transfer movements of the carriages 23 to 31.

Figure 4:
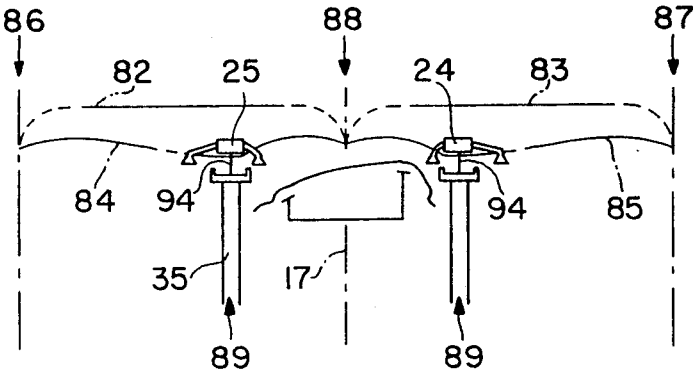
FIG. 4 is a diagram of the movements of the carriages of the transfer device generated by the driving devices shown in FIG. 3.

As shown in FIG. 3, each of the lifting rod linkages 21, in its initial position, can be changed by a lowering movement, of an adjusting drive as will be described below in order to achieve an additional lowered position by a movement 94 as shown in FIG. 4 for the moving rails 18 which cannot be provided by the cam disks 44. This lowered position is required for the depositing of the traverses 34 on the supports 35 of the sliding tables 13 during the tool change and the changing of the holding devices 40.

For this purpose, each adjusting drive has an adjusting motor 51 which drives a spindle 52. The rotating movement of the spindle 52, by means of a pair of toothed gears 53, is transmitted to a second spindle 49. In the cover plate 54, a moving thread (nut) is inserted which interacts with the spindle 49 and thus, during the rotation of the spindle 49, causes a change or shifting of the length of the lifting rod linkage 21.

The cam disks 43, 45 for the movement of the carriages 23 to 31 are designed such in their curved paths tapped by the cam follower levers 47, 48 that the first carriage 23 and each next-plus-one carriage 25, 27, 29, 31, corresponding to FIG. 4, carries out a transfer movement 82 in transfer direction 32 as seen in FIG. 4 from a working stage 86 into an idle stage 88 having the intermediate storage device 17 for supporting a sheet metal part 33 and a return movement 84 into working stage 86 which, at an intermediate position 89 between working stage 86 and idle stage 88, is interrupted during the time of the deformation or working of the sheet metal part 33.

The second carriage 24 and each next-plus-one carriage 26, 28, 30 connected with it simultaneously carries out a transfer movement 83 in transfer direction 32 as shown in FIG. 4 from an idle stage 88 having the intermediate depositing device 17 for supporting a sheet metal part 33 into a working station 87 and a return movement 85 into the idle stage 88 which, at an intermediate position 89 between the idle stage 88 and the working stage 87, is temporarily interrupted during the deforming or working of the sheet metal part 33. The working stages are characterized by the tools 14, 15.

The vertically extending motional parts of the curves 82, 83, 84, 85 shown in FIG. 4 are caused by means of the cam disks 44 which are moved synchronously with the cam disks 43, 45.

Figures 5, 5A:
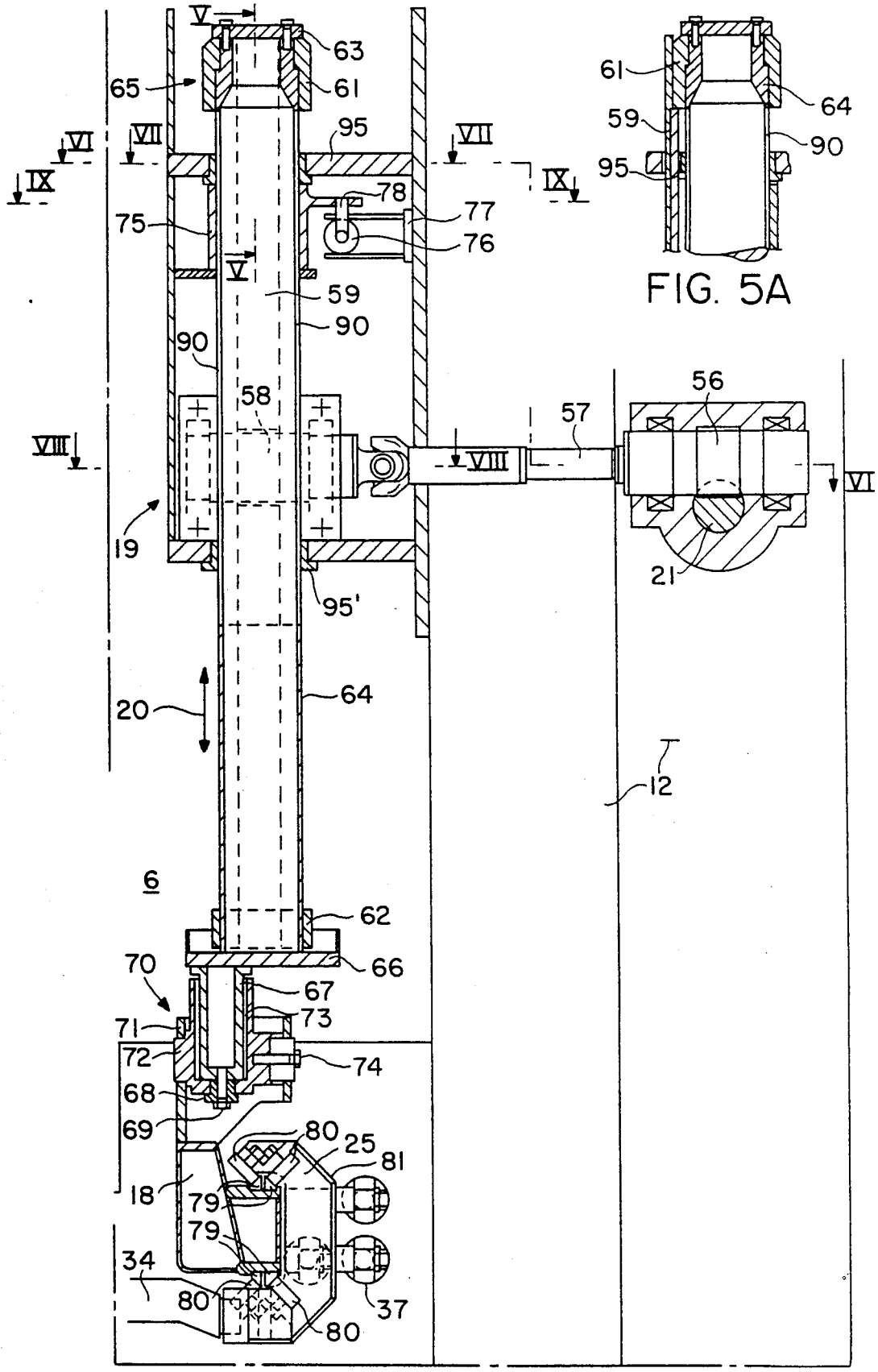
FIG. 5 is an enlarged sectional view taken along line V—V in FIG. 3.
FIG. 5A is an enlarged sectional view taken along line VA—VA in FIG. 5.
Figure 6:
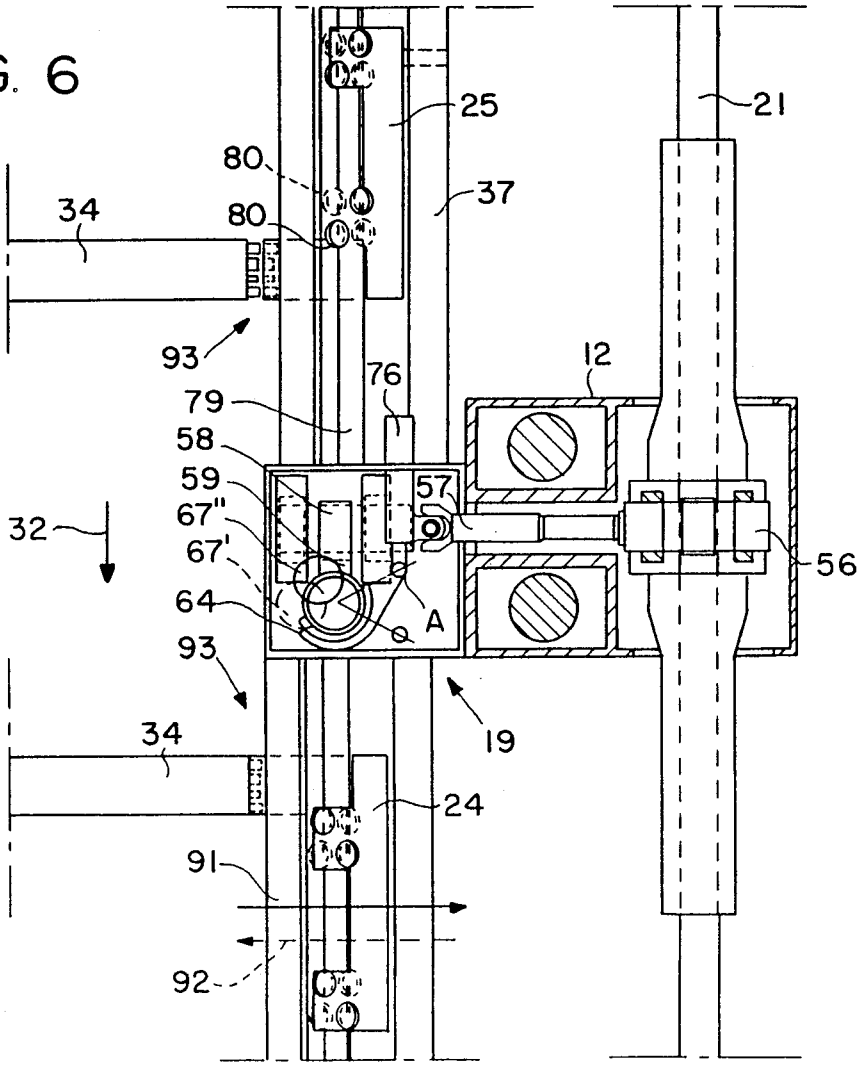
FIG. 6 is a sectional view taken along line VI—VI in FIG. 5.

The sectional view of FIG. 5 and partially also the sectional view of FIG. 6 shows the area of one of the frames 12 of the hybrid press installation which has a deflecting gear 19. The lifting rod linkage 21, in FIG. 5, extends vertically with respect to the plane of the drawing. The movement of the lifting rod linkage 21, by means of a toothing and engagement with a spur wheel 56 and a rotating shaft 57, is transmitted to a second spur wheel 58. The second spur wheel 58 interacts with a toothed rack 59. The end areas of the toothed rack 59 are firmly connected with an upper flange bushing 61 and a lower flange bushing 62. The upper flange bushing 61 forms a running surface 65 for a lifting pipe 64. The upper flange bushing 61 also interacts with a cover plate 63 which is screwed on an upper collar of the lifting pipe 64. This connection permits a pivotal movement of the lifting pipe 64 about pivot point A as shown in FIG. 6.

The pivotal movement of the lifting pipe 64 is caused by means of an adjusting device 76, such as a pressure cylinder which, by means of a bearing block 77, is fixedly mounted at the frame 12. The bearing block 77 permits a swivelling motion of the adjusting device 76. At reference number 78, the adjusting device 76 is pivotally connected to a ring bush 75. The ring bush 75, for example, by means of guide bolts, engages in longitudinal grooves 90 of the lifting pipe 64 in order to permit the lifting and lowering movement 20 of the lifting pipe 64 required for the moving rails 18 and permit the pivotal movement of the lifting pipe 64.

At its lower end part, the lifting pipe 64 carries a flange 66 with a flanged bush 67. The flanged bush 67 is surrounded by a bearing bush 73 and a support bush 72 for forming a pivot bearing between the lifting pipe 64 and a support 71. The support bush 72 is held in a support 71 by means of a screwed connection 74. A flange bushing 68 is placed on the lower end of the support bush 72. A screw device 69 is guided through the flange bushing 68 in order to fasten the support 71 to the lifting pipe 64. The moving rail 18 is rigidly connected with the support 71. The moving rail 18 has two rails or rail pairs 79 on which rollers 80 of carriages 23 to 31 roll, in this case, the rollers 80 of carriage 25. The conveying rod system which is connected to the housing 81 of the carriage 25 has the reference number 37. As a result of the pivoting movement of the lifting pipe 64 by means of adjusting devices 76, an adjustment of the moving rails 18 is possible from the inside to the outside as shown in FIG. 6 by arrow 91, for example, for the uncoupling of the traverses 34 from the moving carriage 25, or from the outside to the inside as shown in FIG. 6 by arrow 92, for the corresponding coupling.

FIG. 5A shows the connection of the toothed rack 59 at the upper flange bushing 61.

FIG. 6 also shows the positions 67' for the operative position and 67'' for the uncoupling and coupling position of the traverses 34 caused by adjusting devices 76.

Reference number 93 indicates coupling areas or couplings for the detaching of the traverses 34 from the carriages, in this case, carriages 24, 25, or the coupling to these carriages as a result of a movement of the moving rails 18 in one of the directions of arrows 91, 92. In the operative position, the rails 79 at the moving rails 18 are located in the center with respect to the lifting pipe 64.

Figure 7:
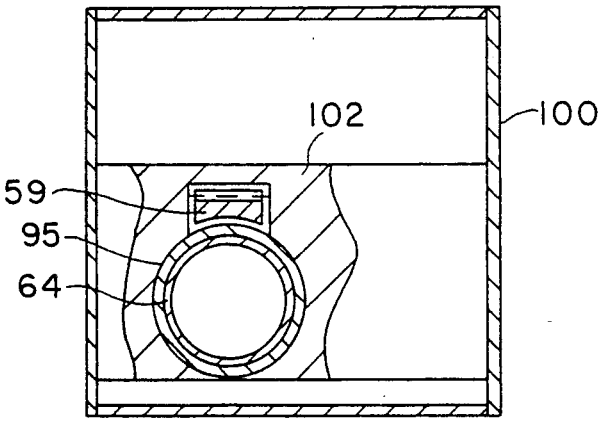
FIG. 7 is a sectional view taken along line VII—VII in FIG. 5.

The section shown in FIG. 7 shows a transmission housing 100 with a crosspiece 102. In the crosspiece 102, a bearing bush is arrange which in FIGS. 5 and 7 has the refernce numeral 95. This bearing bush 95 is a slide bearing and permits rotating movements as well as lifting/lowering movements of the lifting pipe 64. The toothed rack 59 is connected with the lifting pipe 64 by the upper flange bushing 61 and the lower flange bushing 62, as can be seen at the top of FIG. 5. The lifting pipe 64 may be rotated in the flange bushing 61. A running surface is provided for this purpose. This means that the toothed rack 59 only goes along in the lifting/-lowering movement of the lifting pipe 64 but not in its rotating movements.

Figure 8:
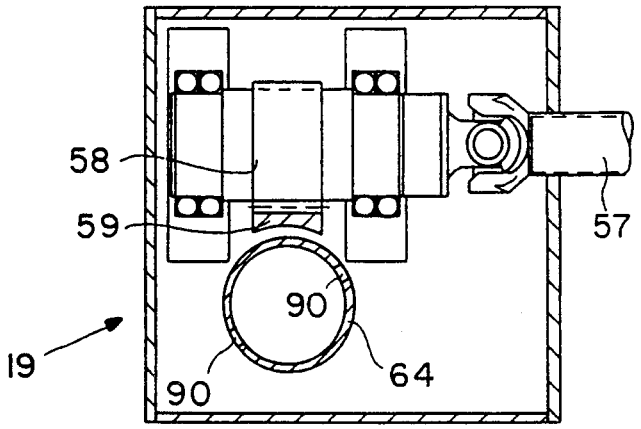
FIG. 8 is a sectional view taken along line VIII—VIII in FIG. 5.

FIG. 8 shows the transmission devices of the rotating movements of the rotating shaft 59 via the spur wheel 58. Longitudinal grooves in the wall of the lifting pipe 64 have the number 90.

Figure 9:
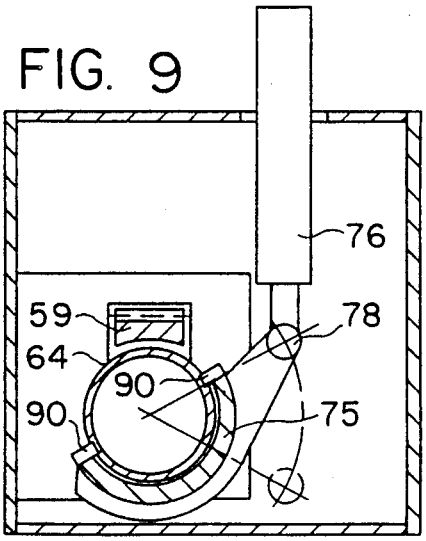
FIG. 9 is a sectional view taken along line IX—IX in FIG. 5.

According to FIG. 9, pins engage in these grooves 90 which are fastened to the ring bush 75 which in this case has the shape of a half-shell. When the adjusting device 76 seen in FIGS. 5, 7, 10 and 11 is acted upon, the two rotating positions (FIGS. 10 and 11) for the lifting pipe 64 can be achieved. In the illustrated embodiment, the pivotal point 78 is formed by a hinge joint, but can also be formed by a slide bearing, for example.

The ring bush 75 rotates only around a central axis and in the process turns the lifting pipe 64. However, the lifting pipe 64 can be lifted and lowered in the bush 75. The adjusting device 76 is pivotally arrange on the bearing block 77. The pivotal point 78 moves along an arc of a circle. This arc is show in FIG. 9. Since the lifting pipe 64 is rotatable in the bearing 95 and in a second bearing 95', the ring bush 75 can also be rotated around the common rotating shaft of the lifting pipe 64 and the ring bush 75 together with the lifting pipe 64.

Figure 10:
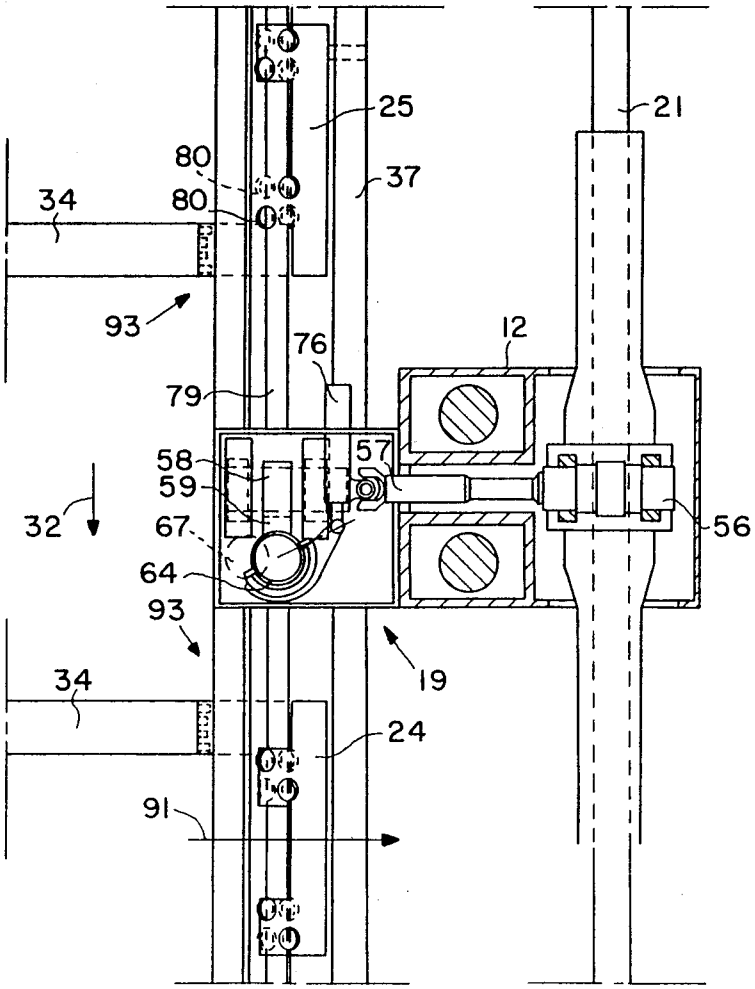
FIG. 10 is a sectional view similar to FIG. 6 with the moving rails being shown in the coupled or operating position for the traverse.
Figure 11:
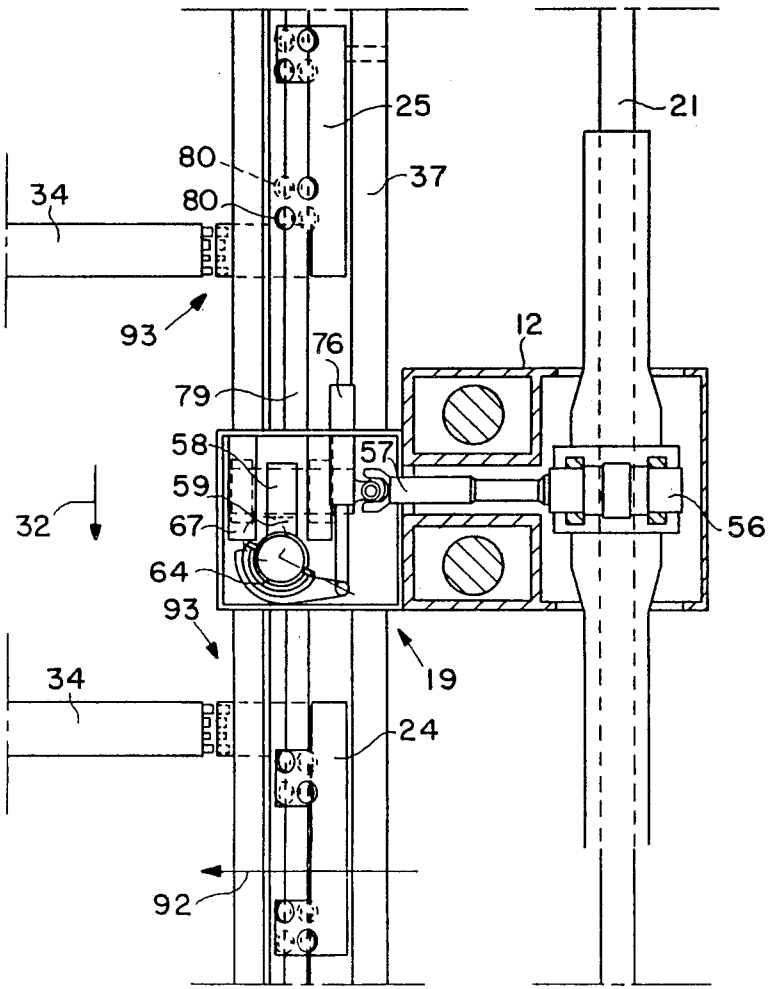
FIG. 11 is a sectional view similar to FIG. 10, with the moving rails being shown in the uncoupled position.
Figure 12:
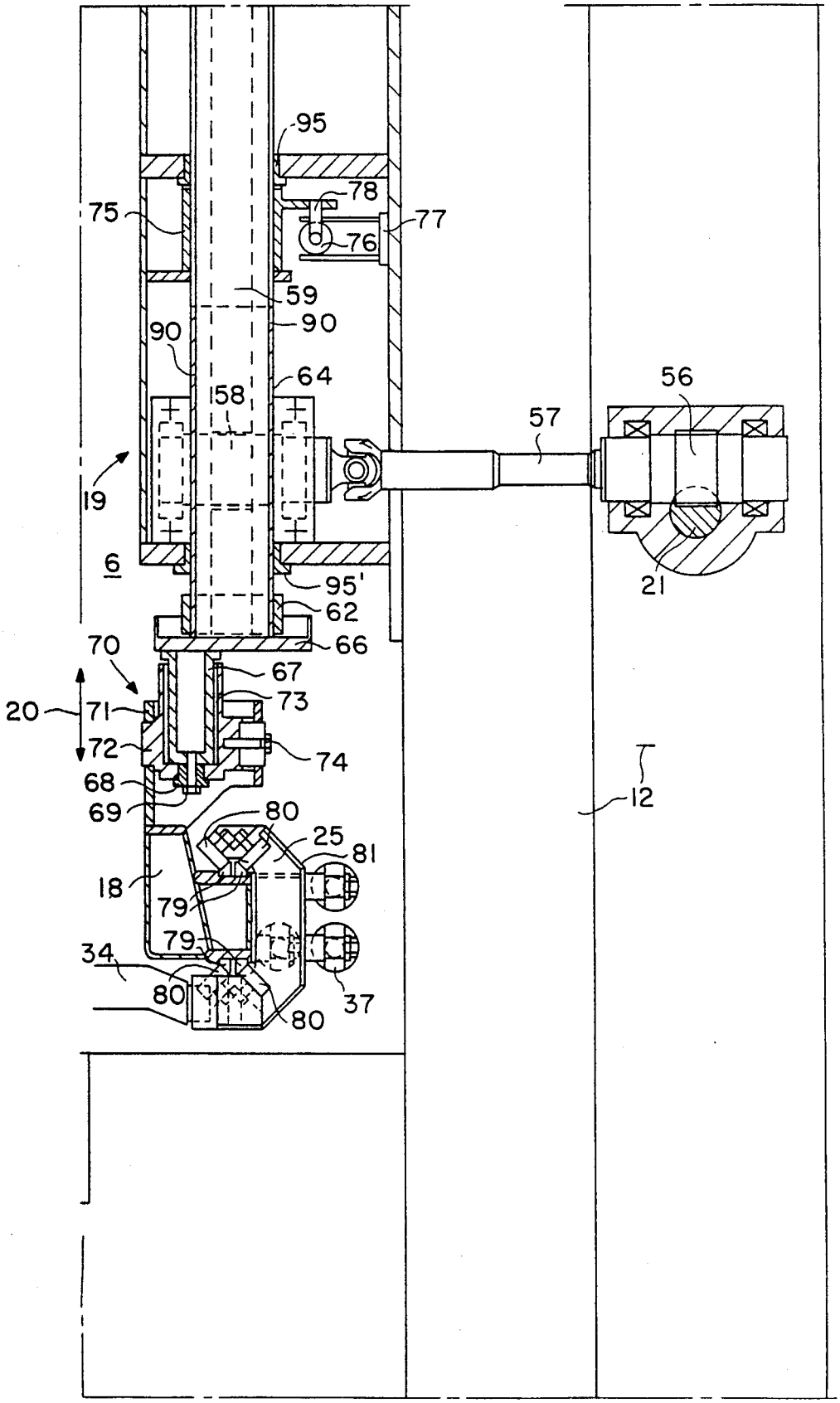
FIG. 12 shows a lifting pipe, an eccentric bearing and the moving rails in a lifted operating position in comparison to FIG. 5.

The rotating movement of the lifting pipe 64 is used for the coupling or uncoupling of the traverses 34 during the retooling of the transfer press. The lifting and lowering of the lifting pipe 64 is used for the lifting and lowering of the moving rails 18, 79 and thus of the carriages 23–31 and of the traverses 34 in order to lift the sheet metal parts out of the tools or deposit them in the tools. The rotating movements for the coupling and uncoupling are shown in FIGS. 6, 10 and 11. FIG. 5 shows the lowered position of the lifting pipe 64, while FIG. 12 shows the lifting position of the lifting pipe 64.

The angle of rotation between the coupling position and the uncoupling position according to FIG. 6 as well as FIGS. 10, 11 depends, for example, on the length of the pins, for example 10 mm, which is shown at 93. These pins lock each of the traverses 34 at the carriages 23–31.

The extent of the rotation of the lifting pipe 64 from position 64' into position 64'', shown in detail in FIG. 6, is a result of the necessity that the coupling 93 or couplings together must be released or closed for the traverses 34. Coupling ranges 93 are outlined in FIGS. 6, 10 and 11. It is therefore necessary to move the rails 18, 79 by, for example, 10 mm transversely to the direction 32 of the sheet metal part transport. This takes place simultaneously in all areas of the deflecting gears 19.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A press including a working stage having at least one slide, movable up and down by driving means, for the deforming of sheet-metal parts, sliding tables for changing tools of the slide and transfer means moveable in synchronism with operation of the press having holding means for gripping and for conveying sheet metal parts through the press, wherein the transfer means has two moving rails, movable substantially vertically in lifting and lowering directions by lifting and lowering means, the rails extend in a conveying direction of the sheet metal parts on opposite sides of the slide and tools of the slide and on which moving carriages are slidably arranged, wherein at least two moving carriages located opposite one another on the two moving rails are connected with one another by at least one traverse at a coupling means arranged between each of the carriages and associated traverse, the at least one traverse carrying the holding means so that the at least two carriages and coupled traverse move along the rails to convey the sheet metal parts through the press and wherein the moving rails are operatively connected with adjusting means fixed to the press, the adjusting means cooperates with the lifting and lowering means and has an adjusting member which is moved substantially horizontally and essentially transversely with respect to the conveying direction of the sheet metal parts by means of the adjusting means for a movement of the moving rails towards and away from one another for coupling a traverse to its associated carriages and an uncoupled position for uncoupling a traverse from its associated carriages.

2. A press according to claim 1, wherein the adjusting means is fixed to the frame and includes a ring bush pivotally moved by the adjusting means and a lifting pipe rotatably held by the ring bush, the lifting pipe, in an area interacting with the moving rail, having an eccentric at which the moving rail is disposed in a pivot bearing, said means for lowering and lifting said rails comprising said lifting pipe.

3. A press according to claim 1, wherein the two moving rails each have rail pairs and the adjusting means, is arranged at a frame of the press and has a center of rotation and pivot coincident with a common center of rail pairs.

4. A press according to claim 1, wherein the lifting and lowering means comprises a toothed rack, which extends in the lifting and lowering direction of the moving rails and is operatively continuously engaged with a drive means by a spur gear means has an upper flange bushing which is fixed to an upper end area of the toothed rack and a lower flange bushing fixed to a lower end area of the toothed rack, and wherein a lifting pipe is rotatably disposed extending in the lifting and lowering direction and projects downward over the tooth rack for the formation of an eccentric bearing providing a horizontal displacement of the moving rail.

5. A press according to claim 1, wherein the press is a transfer press.

6. A press according to claim 1, wherein the press is a bulky part transfer press.

7. A press according to claim 1, wherein the press is a press installation.

8. A press including a work stage, having at least one slide, which can be moved up and down by driving means, for deforming sheet-metal parts, sliding tables for facilitating a changing of tools of the slide and transfer means movable in synchronism with the press having holding means for gripping and for conveying sheet metal parts through the press, wherein two moving rails, extending through the press in a conveying direction of the sheet metal parts, on both sides of the slide and associated tools are lifted and loWered by a first adjustment means, wherein carriages are slidably disposed at the two moving rails, in each case, two carriages being connected at the two moving rails by at least one traverse and coupling means respectively positioned between each of the carriages and associated traverse, the at least one traverse carrying the holding means, said first adjustment means lifting and lowering said rails from an initial height so that said carriages and coupled traverse move said sheet-metal parts through said press, wherein by a second adjusting device, the two moving rails are moved, independently of and cooperating with the first adjustment means, between said initial height and a second position lower than that possible by the first adjustment means for lowering the traverses on supports at the sliding table and wherein by additional adjustment means and deflecting device cooperating with the first adjustment means, the moving rails are adjusted from an operative position for conveying sheet metal parts through the press into an uncoupled position for uncoupling the traverses from associated carriages and back into the operative position.

9. A press according to claim 8, wherein the press is a transfer press.

10. A press according to claim 8, wherein the press is a bulky part transfer press.

11. A press according to claim 8, wherein the press is a press installation.

* * * * *